United States Patent [19]

Toker

[11] Patent Number: 4,488,590

[45] Date of Patent: Dec. 18, 1984

[54] APPARATUS FOR STRIP CASTING HAVING A HEATED ORIFICE

[75] Inventor: Nazmi Y. Toker, Monroeville, Pa.

[73] Assignee: Allegheny Ludlum Steel Corporation, Pittsburgh, Pa.

[21] Appl. No.: 397,717

[22] Filed: Jul. 13, 1982

Related U.S. Application Data

[63] Continuation of Ser. No. 194,096, Oct. 6, 1980, abandoned.

[51] Int. Cl.[3] ..... B22D 11/10

[52] U.S. Cl. ..... 164/423; 164/429; 164/437

[58] Field of Search ..... 164/427, 437, 423, 429, 164/337, 121, 463, 488, 338.1, 338.2, 138, 309, 316, 418, 472; 222/591, 593

[56] References Cited

U.S. PATENT DOCUMENTS

| | | | |
|---|---|---|---|
| 4,142,571 | 3/1979 | Narasimhan | 164/68 |

FOREIGN PATENT DOCUMENTS

| | | | |
|---|---|---|---|
| 40072 | 11/1981 | European Pat. Off. . | |
| 1099394 | 9/1955 | France | 222/593 |
| 55-05138 | 1/1980 | Japan | 164/316 |
| 55-05139 | 1/1980 | Japan | 164/316 |
| 521689 | 5/1940 | United Kingdom . | |

OTHER PUBLICATIONS

"Continuous Casting", by E. Germann, Moscow 1961, pp. 210–212, and 702.

*Primary Examiner*—Nicholas P. Godici
*Assistant Examiner*—Richard K. Seidel
*Attorney, Agent, or Firm*—Patrick J. Viccaro

[57] ABSTRACT

A strip casting apparatus is disclosed comprising a tundish for receiving and holding molten metal and an orifice passage defined between two spaced lips through which the molten metal is delivered to a casting surface located within about 0.120 inch of the orifice passage and movable past the orifice passage at a speed of from 200 to 10,000 linear surface feet per minute. In the apparatus of the present invention at least one lance is disposed with a tip of the lance directed toward a cavity in the tundish adjacent at least a portion of the material defining at least one of the lips of the orifice passage. Equipment is provided for delivering reactive gases through the lance and into the cavity, and at least one aperture is provided through which combustion products from the reactive gases escape the cavity in the tundish. One lip defining the orifice passage of this invention may comprise a molten metal resistant plate. The improvement of this invention comprises a heat conductive layer in the cavity in the tundish at least at a location where the reactive gases from the lance impinge against the tundish material.

3 Claims, 5 Drawing Figures

APPARATUS FOR STRIP CASTING HAVING A HEATED ORIFICE

This is a continuation of application Ser. No. 194,096, filed Oct. 6, 1980, now abandoned.

BRIEF SUMMARY OF THE INVENTION

The present invention is directed to an improved tundish assembly wherein as orifice of the tundish is able to be heated prior to and during a strip casting operation. More particularly, the present invention pertains to a heat conductive layer provided in the tundish at least at a location where reactive gases impinge against the tundish material.

In the development of strip casting apparatus it has become increasingly apparent that the nozzle or orifice passage through which molten passes to a casting surface, is a critical feature. In particular, the slot defining the orifice passage must have a substantially uniform width dimension across the longitudinal extent thereof. The spacing of the orifice lips from a casting surface during a casting operation is also important. The maintenance of the slot dimensions during a casting operation and minimizing the possibilities of the orifice passage freezing during a casting operation have become more critical considerations as the width of the strip material, and likewise the overall width of the orifice passage, increases.

In a co-filed patent application of the present Assignee Ser. No. 194,097, filed Oct. 6, 1980, entitled "Heated Orifice of a Strip Casting Apparatus", an apparatus for heating the orifice in a strip casting tundish is set forth. Generally, such apparatus includes at least one lance with the tip thereof disposed within a cavity in the tundish. By delivering reactive gases through such lance and into the cavity, heat transfers through the lips defining the orifice passage and keeps such lips hot before and during the casting operation.

It has been found, however, that such reactive gases could adversely affect certain tundish materials, especially when used over prolonged periods. For example, such constantly impinging gases may cause flame abuse and chemical attack of the tundish materials, particularly at the location in the tundish where such reactive gases impinge against the tundish materials.

Accordingly, a new and improved apparatus for casting metallic strip material is desired which permits heating of the orifice passage, yet insures that the tundish materials are protected from flame abuse, chemical attack and the like as a result of the heating operation.

The present invention may be summarized as providing a new and improved apparatus for continuously casting strip material comprising a tundish for receiving and holding molten metal, and an orifice passage defined between two spaced lips through which the molten metal is delivered from the tundish to a casting surface located within about 0.120 inch of the orifice passage and movable past the orifice passage at a speed of from 200 to 10,000 linear surface feet per minute. In the apparatus of the present invention at least one lance is disposed through a portion of the tundish with a tip of the lance directed toward a cavity in the tundish adjacent at least a portion of the material defining at least one of the lips of the orifice passage. Equipment is provided for delivering reactive gases through the lance and into the cavity, and at least one aperture is provided through which combustion products from the reactive gases escape the cavity in the tundish. One lip defining the orifice passage of this invention may comprise a molten metal resistant plate. The improvement of this invention comprises a heat conductive layer in the cavity in the tundish at least at a location where the reactive gases from the lance impinge against the tundish material.

Among the advantages of the present invention is the provision of a strip casting apparatus able to heat the orifice passage without adversely affecting the tundish material during heating.

An objective of the present invention is to provide an improved strip casting apparatus in which at least one of the surfaces forming the orifice passage of the tundish may be continuously heated, before, during or after a casting operation without adversely affecting the tundish material.

Another objective of this invention is to provide a heat conductive layer within the tundish at a location where reactive gases impinge against the tundish material which layer is able to protect the tundish material from flame effects and chemical attack, and yet promotes heat transfer therethrough to maintain the orifice passage in a heated condition.

Another advantage of this invention is to provide a strip casting apparatus in which the dimensions of the slot defining the orifice passage in the apparatus of the present invention are adequately maintained even when relatively wide strip material is being cast.

These and other objectives and advantages will be more fully understood and appreciated with reference to the following detailed description and to the accompanying drawings.

DETAILED DESCRIPTION

Figure 1:
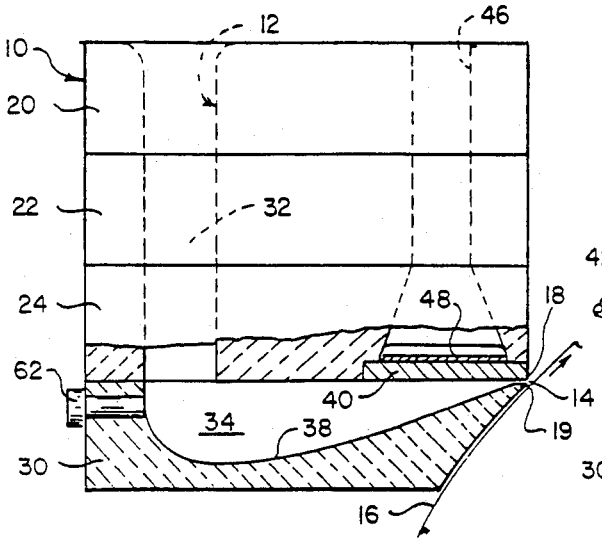
FIG. 1 is a side elevation view, partly in section, of a tundish of the present invention illustrating means for heating a plate forming part of the orifice passage.

Referring particularly to the drawings, the Figures illustrate various preferred apparatus of the present invention. As shown in FIGS. 1 through 4, the apparatus includes a tundish generally designated by reference numeral 10. The tundish 10 has an internal cavity 12 also called the molten metal pouring passage. Such passage 12 is identified by one set of hashed lines in the side elevation portion of FIGS. 1 and 3. The internal cavity, or passage 12 is designed to receive and hold molten metal. The tundish 10 further includes a nozzle or orifice passage 14, through which the molten metal in the tundish 10 is delivered to a casting surface 16.

Figure 2:
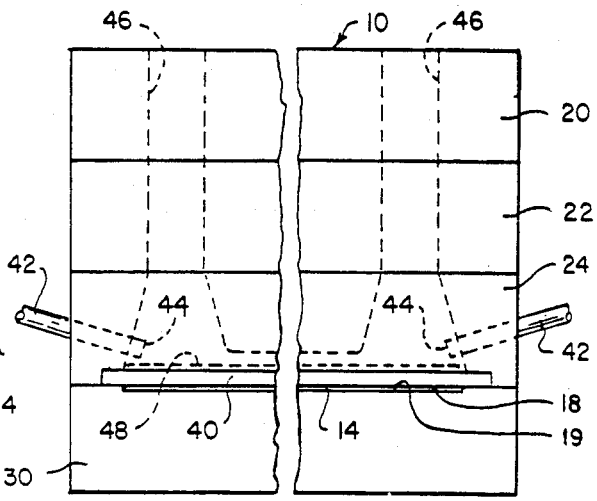
FIG. 2 is a front elevation view of the tundish shown in FIG. 1.

In the present invention, the orifice passage 14 is defined between two lips; an upper lip 18 and a lower lip 19. As best shown in FIG. 2, the lips 18 and 19 are substantially uniformly spaced from one another across the longitudinal extent of the orifice passage at a width of at least about 0.010 inch.

In a preferred embodiment, molten metal is delivered from the orifice passage 14 onto the outer peripheral surface 16 of a water cooled precipitation hardened copper alloy wheel containing about 99% copper. Copper and copper alloys are chosen for their high thermal conductivity and wear resistance although other materials may be utilized for the casting surface 16. In the operation of the apparatus of the present invention, the casting surface 16, whether round, flat or ovular, is movable past the nozzle at a speed of from about 200 to about 10,000 linear surface feet per minute.

As shown in the drawings, the tundish 10 may consist of at least one upper block 20 and at least one lower block 30. As used in the present invention, the terms upper and lower, as well as the terms front and rear are used with general respect and reference to the casting surface 16, with the terms upper and rear referring to locations away from the casting surface 16. The upper and lower blocks 20 and 30 of a preferred tundish 10 of the present invention are preferably vertically aligned and secured together. Such vertical alignment is discussed and explained in a co-filed patent application Ser. No. 148,440, filed May 9, 1980, entitled "Apparatus For Strip Casting". It should be appreciated that the secured blocks must not allow molten metal in the passage 12 to pass through the interface of the assembly. It should also be understood that in instances where the orifice passage 14 is located at an interface, as shown in FIG. 2, molten metal is intended to pass therethrough. Therefore, the interface through which molten metal must not pass, as defined above, is not intended to include an orifice passage 14 of the tundish 10.

Any number of intermediate blocks, such as blocks 22 and 24 may be disposed between the upper block 20 and the lower block 30 when a vertically aligned tundish is utilized. It should be understood that various alternative tundish designs may be employed such as horizontally aligned and secured blocks of molten metal resistant materials, or monolithic structures may be utilized.

The blocks utilized in a preferred apparatus of the present invention must be of a material which is resistant to molten metal attack. In this regard, it has been found that refractory boards, such as insulating boards made from fiberized kaolin are suitable. Additional materials including graphite, alumina graphite, clay graphite, fire clay, quartz, boron nitride, silicon nitride, silicon carbide, boron carbide, alumina, zirconia, stabilized zirconium silicate, alumina, silica, magnesia, chrome magnesite, and combinations of such materials may also be used to construct such blocks.

In a preferred embodiment, the tundish is constructed of vertically or horizontally stacked sections of 1.5 inch thick Kaolwool fiberboard. It should be noted that thicker or thinner blocks may be employed depending upon the desirable strip casting conditions. The 1.5 inch thick blocks are utilized in a preferred embodiment because of their commercial availability. Furthermore, such fiberized kaolin blocks are preferred because of their relatively low cost and because of the relative ease with which they can be drilled and carved into desired configurations. However, it should be understood that other materials such as those enumerated above, may perform equally well and may be cast instead of carved into any desired configurations.

Figure 3:
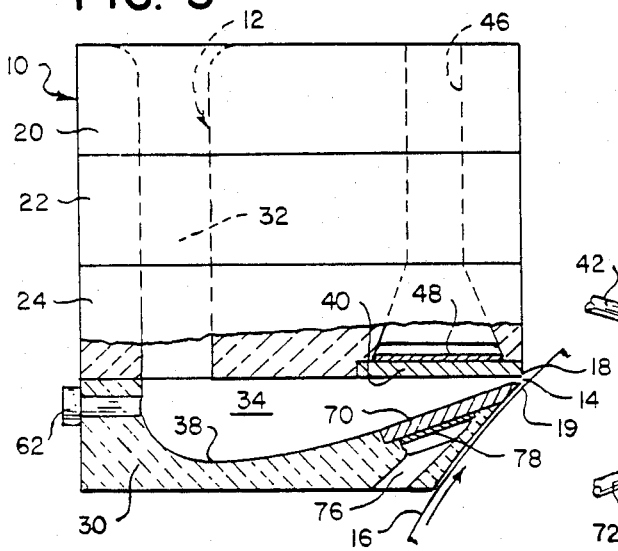
FIG. 3 is a side elevation view, partly in section, of an alternative tundish of the present invention.

The tundish 10 of the present development typically includes a molten metal pouring passage 12 consisting of at least one introductory passage portion 32. The introductory passage portion 32 extends through the tundish and is in communication with a base passage portion 34 formed in a hollow section at a lower portion of the tundish 10. The opening for the introductory passage 32 is preferably located in an upper surface of the tundish as shown in FIGS. 1 and 3, however, such opening may be disposed elsewhere. Also, as shown in the Figures it is preferred that the opening be slightly radiused into a funnel shaped structure to facilitate metal transfer therethrough.

The base passage portion 34 and the orifice passage 14 are important features in the strip casting apparatus of the present invention. The base passage 34 is typically carved or cast in the bottom portion of the tundish 10. Though not required, the majority of a bottom surface 38 of the base passage 34 is preferably disposed below the vertical height of the orifice passage 14. In a preferred embodiment, at least a portion of the bottom surface 38 of the base passage 34 is disposed at least about 0.3 inch below the nozzle 14. Furthermore, it is desirable that the bottom surface 38 of the base passage 34 extend toward or approach the nozzle at an angle of at least about 30° from horizontal.

The orifice passage 14 through which molten metal is fed onto a casting surface 16 has a substantially uniform width dimension, W, throughout the longitudinal extent thereof. Such width dimension, W, is at least about 0.010 inch and is less than 0.120 inch, or more preferably less than 0.080 inch. In a most preferred embodiment such width dimension, W, is within the range of from about 0.020 to 0.060 inch, and even more preferably from about 0.030 to 0.050 inch.

The orifice passage 14 may be constructed in a number of ways in the apparatus of the present invention. In a preferred embodiment, at least one lip defining the orifice passage 14 consists of a molten metal resistant sheet or plate. For example, as illustrated in FIG. 2, the orifice passage 14 may be formed between a bottom surface of a plate 40 defining the upper lip 18 of the nozzle 14, and a portion of the front wall of the tundish 10, defining the lower lip 19 of the nozzle 14. It should be understood that the orifice passage 14 could alternatively be formed between a lower plate and the tundish 10, or between two facing plates. Regardless of which method is used to provide the orifice passage 14 the strict dimensional tolerances mentioned above must be maintained.

Figure 4:
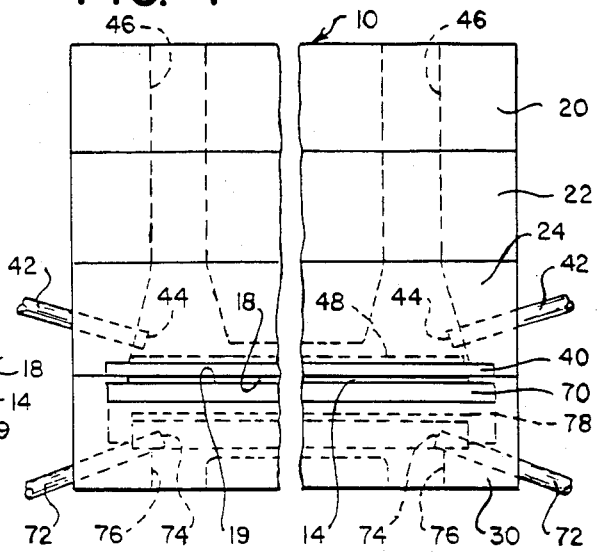
FIG. 4 is a front elevation view of the tundish shown in FIG. 3.
Figure 5:
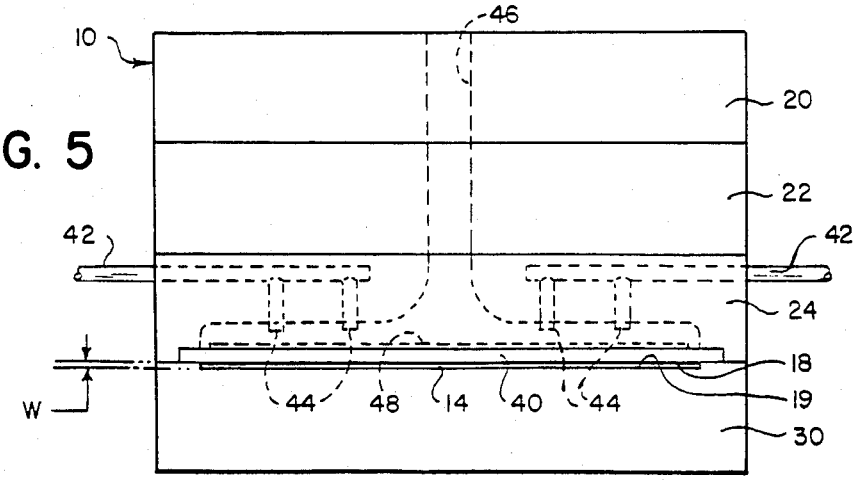
FIG. 5 is a front elevation view of an alternative tundish of the present invention.

In the present invention at least one cavity is provided in the tundish 10 adjacent at least a portion of the material defining at least one of the lips of the orifice passage 14. Such cavity may consist of the bottom portion of a chimney or aperture 46 which is discussed below. Also, such cavity may be provided to extend between multiple apertures as shown in FIGS. 2 and 4. Alternatively, such cavity may be provided in the tundish 10 across substantially the complete extent of the material defining one of the lips of the orifice passage as shown in FIG. 5. Preferably, a plate 40 and/or 70 defines at least one of the lips of the orifice passage. In such embodiment, a portion of the tundish material which is adjacent the outside surface of such plate with respect to the orifice passage 14 may be removed to provide the required cavity. As discussed below, reactive gases are delivered into such cavity, and the heat from such gases must be transferred through the tundish material to heat the orifice passage 14. Therefore, the cavity must be close enough to the orifice passage 14 to accomplish this result, which necessarily depends on the heating temperature and the thermal conductivity of the tundish materials.

As also mentioned above, at least one surface forming the orifice passage 14 preferably comprises the bottom surface of a separate, molten metal resistant sheet or plate 40. When employed, such plate 40 is integrally mounted or otherwise disposed in the tundish 10. As shown, it is preferable that the upper lip 18, of the orifice passage 14 comprise a lower surface of a plate 40 of molten metal resistant material. It should be understood that it is more critical to maintain the upper surface 18 of the orifice passage 14 during casting, as compared to the lower surface 19, and, therefore, it is preferable to use a significantly molten metal resistant plate 40 at such location. However, the bottom surface 19 or alternatively both surfaces 18 and 19 forming the orifice passage 14, such as shown in FIGS. 3 and 4, may consist of plates 40 and/or 70. The plate 40 and/or 70 should be at least as resistant to the molten metal as is the remainder of the tundish materials, and preferably, the plate comprises a material which is significantly more molten metal resistant than the remainder of the tundish 10. As shown in FIG. 2 the plate 40 may be fit into an appropriate slot cut in the bottom surface of an intermediate block 24 of a tundish 10. Alternatively, the plate 40 may comprise a block or a portion of a block of the tundish 10. The plate 40 should have a length greater than the longitudinal extent of the orifice passage 14. Thus, the peripheral end portions of the plate 40 are sandwiched between adjacent blocks 24 and 30 in the assembly illustrated in FIGS. 1 and 2.

In a preferred embodiment the tundish is primarily constructed of fiberized kaolin and has an orifice passage 14 defined by a boron nitride plate 40. However, other materials may be employed for the tundish and plate materials including silicon nitride, silicon carbide, boron carbide, silica, alumina, zirconia, stabilized zirconium silicate, graphite, alumina graphite, fire clay, clay graphite, quartz, magnesia, chrome magnesite and combinations of such materials.

As illustrated in the drawings a lance or multiple lances are provided through the tundish 10 with their tips 44 extending into the cavity adjacent the orifice passage 14. As shown in FIGS. 1, 2 and 5 appropriate lances extend into such cavity to heat the plate 40 forming the upper lip 18 of the orifice passage 14. In a preferred embodiment, at least one lance 42 is disposed in the tundish with the tip 44 thereof directed into the cavity and toward the outside surface of the plate 40. Also, as illustrated in FIGS. 1 and 2, a corresponding aperture or chimney is provided in the tundish 10 through which the combustion products which are delivered from the lance 42 may escape the cavity in the tundish.

In an alternative embodiment illustrated in FIGS. 3 and 4 means may be provided to heat a cavity provided adjacent each of a pair of plates 40 and 70 forming both the upper lip 18 and the lower lip 19, of the orifice passage 14. In addition to the lances 42 discussed above for heating the upper lip 18 of the orifice, such construction would require at least one lance 72 disposed in the tundish 10 with the tip 74 thereof directed into a cavity adjacent the lower plate 70 to heat the lower lip 19 of the orifice passage 14. Also, a corresponding aperture or chimney 76 may be provided in the tundish 10 through which the combustion products which are delivered from the lance 72 to the cavity adjacent the plate 70 may escape the cavity in the tundish 10.

It should be understood that any number of lances or lances with any number of multiple tips, as shown in FIG. 5, may be employed usually dependent upon the width of the strip to be cast from the tundish 10. By utilizing such heating lances sufficient heat is provided and maintained in the cavity to cause heat transfer through the tundish materials to the corresponding lip of the orifice passage 14 to keep the nozzle hot before and during strip casting. When a plate 40 and/or 70 is utilized the temperature of the entire plate 40 can be raised to the desired level prior to the initiation of a strip casting operation. In a preferred embodiment a lance is provided for every 2.0 to 3.0 inches of width of the orifice passage 14. It has been found that heating such plates near, the melting temperature, i.e. within at least about 10% of the melting temperature of the alloy to be cast, typically prevents metal freezing in the orifice passage 14 which may otherwise occur especially at the initiation of a casting operation. Also, preheating of such plates at or near the metal casting temperature allows any expansion or contraction effects to occur and appropriate compensation to be made before casting begins. Therefore, preheating assures that the present orifice dimension and the spacing from the casting surface remain established throughout the casting operation.

In a preferred embodiment high temperature reactive gases are directed through the lance. Such reactive gases pass through the tip of the lance and the flames are directed into the cavity and toward the material defining that lip of the orifice passage 14. Preferred reactive gases include acetylene-air, acetylene-oxygen and antural gas-oxygen mixtures. To reduce the possibility of undesired flame effects on such material, such as the plate 40, or plates 40 and 70 illustrated in the drawings, a more resistant heat conductive layer 48 and/or 78 is provided on at least a portion of the upper surface of the upper plate 40 and the lower surface of the lower plate 70 at least at the location where such flames impinge against the plate 40 and/or 70. Such layer 48 serves to absorb the flame abuse, including restricting chemical attack, and further serves to transfer the heat to and through the plate 40 and/or 70. In a preferred embodiment, such layer 48 is about 3/16 to ¼ inch thick graphite, although other materials may be employed. A protective layer, or multiple layers may be applied to a boron nitride plate by using graphite bearing cements or other refractory coating substances. The heat conductive layer of the present invention includes those materials which absorb thermal and chemical abuse, and are functionally able to transfer heat therethrough as discussed above.

As shown in FIGS. 1 and 3 a drain plug 62 may be provided in a lower portion of the tundish. Such drain plug is preferably located vertically below the orifice passage or nozzle 14 with respect to the force of gravity. The purpose of the drain plug 62 is to quickly stop molten metal from being delivered from the orifice passage 14 when it is desired to stop a casting operation. It will be appreciated by those skilled in this art that it is important to stop a casting operation as quickly as possible. Otherwise, uneven and often intermittent streams of molten metal may flow through the nozzle 14 at the end of a casting operation and such intermittent streams may impinge onto the rapidly moving casting surface without the control necessary to make strip material. Thus, such uncontrolled drippings of molten metal through the nozzle at the end of a casting operation tend to splash onto the successfully cast product and may ruin the strip and perhaps damage some of the strip casting equipment. Also, in order to effect the reusability of the tundish it is important that the molten metal in the cavity 12 be drained from the tundish 10 at the end of a casting operation. By removing such plug 62 substantially all of the molten metal in the tundish passes through the plug orifice and therefore the tundish 10 and the plates 40 and/or 70 forming the orifice passage 14 may be reusable in subsequent casting operations. It should be understood that proper receptacles should be provided to receive the molten metal which passes through the plug orifice from the tundish as the plug 62 is removed.

Whereas, the preferred embodiments of the present invention have been described above for purposes of illustration, it will be apparent to those skilled in the art that numerous variations of the details may be made without departing from the invention.

I claim:

1. A strip casting apparatus comprising a tundish for receiving and holding molten metal, and an orifice passage defined between two spaced lips in the tundish through which the molten metal is delivered to a casting surface located within about 0.120 inch of the orifice passage and movable past the orifice passage at a rate of from 200 to 10,000 linear surface feet per minute, at least one cavity defined in the tundish adjacent at least a portion of the material defining at least one of the lips of the orifice passage, a molten metal resistant plate forming at least one of the lips of the orifice passage, at least one lance disposed through a portion of the tundish with a tip of said lance directed toward said cavity, means for delivering reactive gases through said lance and into said cavity to provide sufficient heat in said cavity to cause heat transfer through the lip to heat at least a portion of said orifice passage, and at least one aperture defined in the tundish in communication with said cavity through which combustion products from the reactive gases escape the cavity in the tundish wherein the improvement comprises:

a heat conductive layer of graphite in the cavity in the tundish on at least a portion of the lip-forming plate of boron nitride at a location where reactive gases from the lance impinge against the plate to protect the tundish material and said plate, said layer being a more resistant material than said plate and able to absorb both thermal and chemical abuse and to transfer heat through the plate to a portion in contact with the molten metal.

2. An apparatus as set forth in claim 1 wherein the tundish is constructed of a molten metal resistant material selected from the group consisting of boron nitride, quartz, graphite, clay graphite, fire clay, silicon nitride, silicon carbide, boron carbide, silica, alumina, zirconia, stabilized zirconium silicate, magnesia, chrome magnesite and combinations thereof.

3. An apparatus as set forth in claim 1 wherein the plate is a molten metal resistant material selected from the group consisting of boron nitride, quartz, graphite, clay graphite, fire clay, silicon nitride, silicon carbide, boron carbide, silica, alumina, zirconia, stabilized zirconium silicate, magnesia, chrome magnesite and combination thereof.

* * * *